US008887523B2

(12) United States Patent
Gommed et al.

(10) Patent No.: US 8,887,523 B2
(45) Date of Patent: Nov. 18, 2014

(54) LIQUID DESICCANT DEHUMIDIFICATION SYSTEM AND HEAT/MASS EXCHANGER THEREFOR

(76) Inventors: Khaled Gommed, Kfar Yafia (IL); Gershon Grossman, Haifa (IL)

( * ) Notice: Subject to any disclaimer, the term of this patent is extended or adjusted under 35 U.S.C. 154(b) by 202 days.

(21) Appl. No.: 13/057,771

(22) PCT Filed: Aug. 10, 2009

(86) PCT No.: PCT/IB2009/053507

§ 371 (c)(1),
(2), (4) Date: Feb. 7, 2011

(87) PCT Pub. No.: WO2010/016040

PCT Pub. Date: Feb. 11, 2010

(65) Prior Publication Data

US 2011/0132027 A1 Jun. 9, 2011

Related U.S. Application Data

(60) Provisional application No. 61/087,367, filed on Aug. 8, 2008.

(51) Int. Cl.

| | |
|---|---|
| ***F28B 3/00*** | (2006.01) |
| ***F25B 17/00*** | (2006.01) |
| ***F25B 15/00*** | (2006.01) |
| ***F28D 5/00*** | (2006.01) |
| ***F28D 21/00*** | (2006.01) |
| ***F24F 5/00*** | (2006.01) |
| ***F28C 3/04*** | (2006.01) |
| ***F24F 3/14*** | (2006.01) |

(52) U.S. Cl.

CPC ..... *F24F 5/0014* (2013.01); *F28D 21/0015* (2013.01); *F28C 3/04* (2013.01); *F24F 3/1417* (2013.01); *F24F 2003/144* (2013.01)

USPC ..... 62/477; 62/304; 62/489; 165/114

(58) Field of Classification Search

USPC ..... 62/94, 97, 143, 238.3, 304, 434, 477, 62/489, 494, 497; 165/114, 145

See application file for complete search history.

(56) References Cited

U.S. PATENT DOCUMENTS

| | | | | | |
|---|---|---|---|---|---|
| 3,267,691 | A * | 8/1966 | Osborn | 62/476 |
| 4,127,993 | A * | 12/1978 | Phillips | 62/101 |
| 4,902,207 | A * | 2/1990 | Hembree et al. | 417/403 |
| 5,016,444 | A * | 5/1991 | Erickson | 62/79 |
| 5,097,676 | A * | 3/1992 | Erickson | 62/476 |
| 5,460,004 | A * | 10/1995 | Tsimerman | 62/94 |
| 5,791,158 | A * | 8/1998 | Klintworth et al. | 62/497 |
| 6,606,881 | B1 * | 8/2003 | Justin | 62/475 |
| 2003/0041608 | A1 * | 3/2003 | Gonzalez-Cruz et al. | 62/235.1 |

* cited by examiner

*Primary Examiner* — Christopher R Zerphey
(74) *Attorney, Agent, or Firm* — Ted W. Whitlock

(57) ABSTRACT

A heat and mass exchanger for a liquid desiccant air conditioning/dehumidification system. The exchanger comprises an absorber solution section operably connected to the system's absorber/dehumidification section and a desorber solution section operably connected to the system's desorber/regeneration section. A partition separating those sections includes at least two interconnecting ports positioned to facilitate flow of relatively weak solution from the absorber solution section into the desorber solution section; and the flow of relatively strong solution from the desorber solution section into the absorber solution section—as well as allowing heat transfer therebetween.

10 Claims, 9 Drawing Sheets

LIQUID DESICCANT DEHUMIDIFICATION SYSTEM AND HEAT/MASS EXCHANGER THEREFOR

FIELD OF INVENTION

The present invention relates to a dehumidification/air-conditioning system, in particular such a system using a liquid desiccant.

BACKGROUND OF THE INVENTION

Growing demand for air conditioning in recent years has caused a significant increase in demand for electrical energy. Global warming, now an undisputed fact, has led to an increase in air conditioning demand not only in hot and humid climates such as in Mediterranean and equatorial countries, but also in European countries with limited air conditioning tradition. Electric utilities have their peak loads on hot summer days, and are often barely capable of meeting the demand, struggling with brown-out situations. With suitable technology, solar cooling systems can help alleviate, if not eliminate the problem. This is a good application for solar energy as the greatest demand for air conditioning occurs during times of peak solar radiation.

A liquid desiccant air-conditioning/dehumidification system is a good alternative to an electric-powered conventional cooling system. Liquid desiccant air-conditioning systems operate essentially as open-cycle absorption devices. Such systems are capable of using industrial waste heat or low-grade solar heat from low-cost flat plate collectors as their source of power, and have the potential to provide both cooling and dehumidification, as required by the load.

Liquid desiccant systems in their "pure" configuration typically provide dehumidified air and not necessarily cooled air. However, a heat exchanger for cooling the dry air can be added, which may even include the addition of a small amount of water to the dried air in order to lower its temperature, while still keeping the air at a comfortable humidity level. Moreover, in many situations and climates, the dehumidification aspect of air conditioning is the most important component of the air conditioning process; and downstream cooling may not be necessary.

Liquid desiccant systems typically include a dehumidifying (absorber) section for removing moisture from humid fresh (or re-circulated) air, by a hygroscopic solution; and a regeneration (desorber) section for re-concentrating the hygroscopic solution, i.e. removing from it a portion of the absorbed moisture.

Examples of such systems are disclosed in U.S. Pat. No. 2,672,024 (McGrath); U.S. Pat. No. 2,798,570 (Kelley); U.S. Pat. No. 6,487,872 (Forkosh et al.); and U.S. Pat. No. 6,546,746 (Forkosh et al.).

OBJECTS OF THE INVENTION

It is an object of present invention to provide an exchanger (container, tank, reservoir or the like) for use in a liquid desiccant air-conditioning/dehumidifying system or any other similar energy/chemical system for the purpose of solution concentration recovery by means of partial mixing of liquid solutions having different temperatures and concentrations.

It is another object of the present invention to provide an integrated absorber and desorber pool or reservoir for a liquid desiccant air-conditioning/dehumidifying system or any other similar energy or chemical system, especially such a pool/reservoir that prevents access of outside air during system idling.

It is another object of the liquid desiccant dehumidification/air-conditioning system of the present invention to provide an improved heat exchanger between an absorber or dehumidification section and a desorber or regeneration section and/or to provide an improved mass (material) exchange between desiccant solution passing back and forth between the absorber/dehumidification section and desorber/regeneration section.

It is yet another object of the present invention to provide a unified heat and/or mass (material) exchanger; especially with application in a liquid desiccant dehumidification/air-conditioning system.

It is yet another object of the present invention to provide means of level control of the desiccant solutions in the absorber and desorber.

SUMMARY OF THE INVENTION

The present invention relates to a heat and mass exchanger for a liquid desiccant air conditioning/dehumidification system. The exchanger comprises an absorber solution section operably connected to the system's absorber/dehumidification section and a desorber solution section operably connected to the system's desorber/regeneration section. A partition separating those sections includes at least two interconnecting ports positioned to facilitate flow of relatively weak solution from the absorber solution section into the desorber solution section; and the flow of relatively strong solution from the desorber solution section into the absorber solution section—as well as allowing heat transfer therebetween.

According to embodiments of one aspect of the present invention there is provided a heat and mass exchanger for a liquid desiccant air conditioning/dehumidification system having an absorber/dehumidification section with an absorber and a desorber/regeneration section with a desorber, the exchanger comprising: an absorber solution section having an inlet for receiving weak solution from the absorber/dehumidification section and an outlet from which strong solution exits to the absorber/dehumidification section; a desorber solution section having an inlet for receiving regenerated solution from the desorber/regeneration section and an outlet from which solution to be regenerated exits to the desorber/regeneration section; a partition separating the absorber solution section and the desorber solution section; and at least two ports connecting between the absorber solution section and the desorber solution section, including a first port disposed at or proximate the top of said partition and a second port at or proximate the bottom of said partition, thereby facilitating the flow of relatively weak solution from the absorber solution section into the desorber solution section via the first port and facilitating the flow of relatively strong solution from the desorber solution section into the absorber solution section as well as allowing heat transfer between the absorber/dehumidification section and the desorber/regeneration section.

According to embodiments of another aspect of the present invention there is provided a liquid desiccant air conditioning/dehumidifying system comprising an absorber/dehumidification section having an absorber for dehumidifying a fluid using a liquid desiccant solution; a desorber/regeneration section with a desorber for regenerating the liquid desiccant solution; and an exchanger facilitating heat and mass exchange as defined above.

It is significant to note that the system does not have to, and typically does not, include an absorber pool, a desorber pool or a solution-solution heat exchanger, as these components are not required due to the existence of the (heat and mass) exchanger. Furthermore, in some embodiments, the system does not require a (desorber pool exit solution) splitter to direct portions of the regenerated solution to different components of the system. In embodiments that do include a splitter, the splitter need not include an associated control system to obtain/maintain and optimum split, rather the heat and mass exchanger is typically and substantially self-regulating (i.e. the splitter is can be set to a constant split ratio).

It is a particular feature of the present exchanger that the mass exchange has a significant passive aspect wherein natural convection due to density differences drives the transfer of the solution therein, although it is understood that movement of the solution is effected by flow into and out of the exchanger, which is typically produced by a pump.

BRIEF DESCRIPTION OF THE DRAWINGS

The invention may be more clearly understood upon reading of the following detailed description of non-limiting exemplary embodiments thereof, with reference to the following drawings, in which.

DESCRIPTION OF SOME EMBODIMENTS OF THE INVENTION

Figure 1:
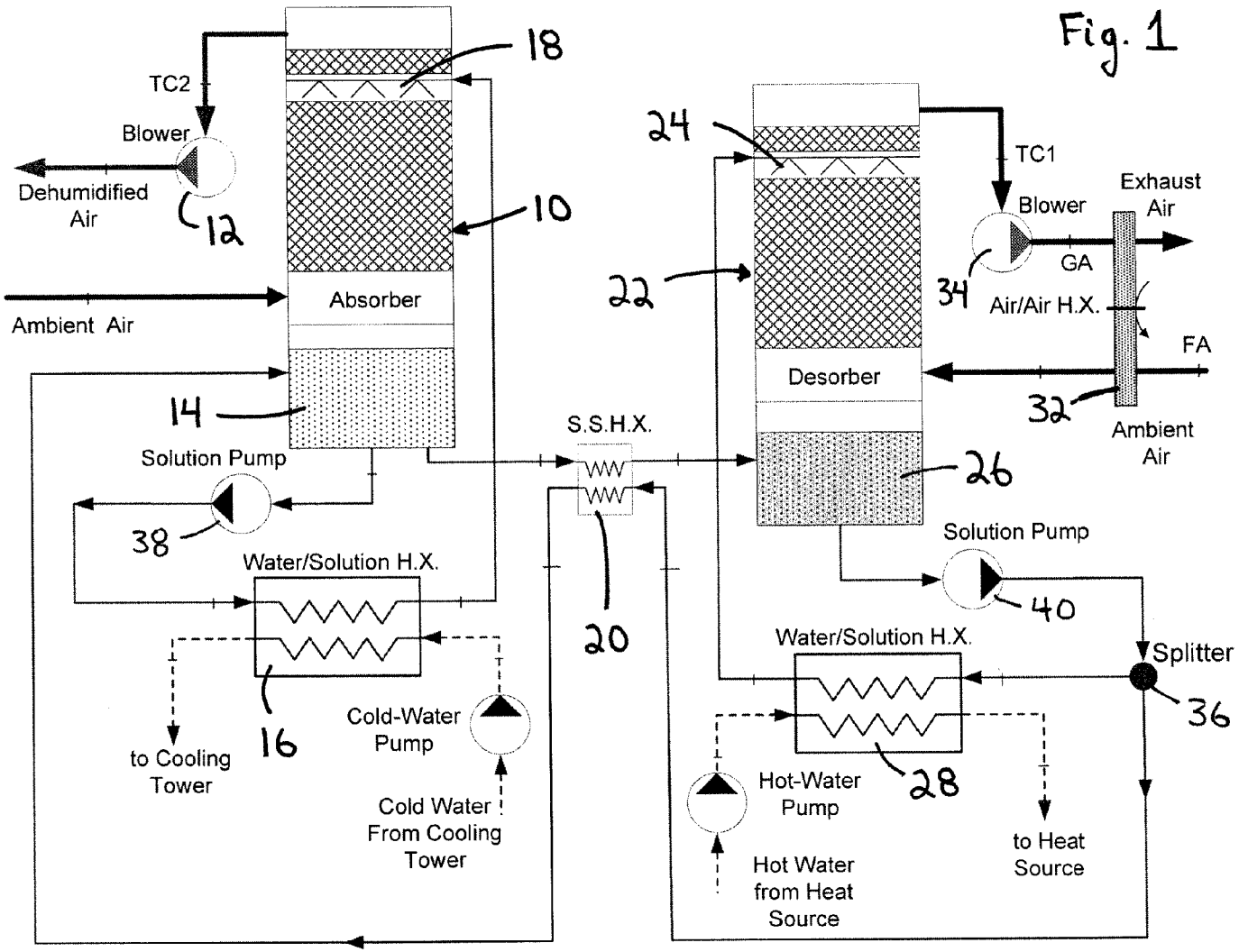
Prior Art Fig. 1
FIG. 1 is a schematic view of a prior art liquid desiccant air conditioning/dehumidification system.

FIG. 1 shows a prior art liquid desiccant air-conditioning system. Not all details of the workings of the prior art system will be described as the system shown in FIG. 1 is exemplary and many other such liquid desiccant air-conditioning systems can be devised; rather merely a general overview of a prior art system will be provided herein.

The prior art system comprises a dehumidifier section (at the left side of the figure) including an absorber (dehumidifier) or absorber tower 10 commonly consisting of an insulated packed tower. Fresh air (e.g. ambient typically warm humid air, air re-circulated from a building, or a combination of both) enters the bottom of the absorber 10; and concentrated absorbent solution (e.g. an aqueous lithium-chloride solution) is delivered to the top of the absorber. The fresh air rises in the absorber 10 and some of the air's moisture is absorbed by descending absorbent solution.

Water vapor is removed from the humid air stream via absorption into the concentrated absorbent solution stream. The dehumidified warm air exiting the absorber 10 passes through a blower 12 (or any suitable means for causing air flow) and leaves the system, and optionally passes through a temperature control system (not shown) for further cooling or heating the air, toward an air conditioned space. Blower 12 controls the flow of air. Warm and diluted absorbent solution collects in an absorber pool 14 at the bottom of the absorber tower 10. Optionally, some of the resultant concentrated absorbent solution is pumped through an absorber/dehumidification section heat exchanger 16, where it is cooled by a cooling fluid from, for example, a cooling tower (not shown). This concentrated and cooled absorbent solution leaving heat exchanger 16 continues to an absorber distributor 18 at the top of the absorber 10, from where it trickles down countercurrent to the incoming fresh/recirculated hot humid air stream to once again collect in the absorber pool 14. Warm and diluted absorbent solution exits the absorber pool 14 and enters an absorber/desorber (solution-solution) heat exchanger 20, where the solution is heated while cooling regenerated absorbent solution from a solution regenerator (desorber) section. The level of solution in absorber pool 14 is controlled by a level-control mechanism (not shown).

The regenerator (desorber) section is quite similar to the dehumidifier section, and so are the flow system and associated components. The regeneration system comprises a desorber or desorber tower 22 having a distributor 24 with a desorber pool 26 below. Dilute and relatively cool solution exiting absorber/desorber heat exchanger 20 enters desorber pool 26. The level of solution in absorber pool 14 is controlled by a level control mechanism (not shown).

Some of the absorbent solution from desorber pool 26 is pumped through a desorber/regeneration section heat exchanger 28 where it is heated by fluid (typically hot water) heated by solar energy or another form of low-grade heat. This absorbent solution continues to desorber distributor 24 at the top of the desorber 22. Ambient air is pre-heated in an air-to-air heat exchanger 32 by recovering heat from exhaust air leaving the desorber 22. After pre-heating, the air stream enters the bottom of the desorber 22 where it serves to reconcentrate the solution by removing water from the absorbent solution. The exhaust air leaves the desorber, passing through a blower 34 (or any suitable means for causing air flow) and pre-heats the entering air stream.

In order to remove weak absorbent solution from the absorber 10 and replace it with strong regenerated (concentrated) absorbent solution from the desorber 22, a controlled amount of solution is continuously transferred from desorber pool 26 to absorber pool 14, typically driven by gravity, after passing through absorber/desorber (solution-solution) heat exchanger 20.

For the system to provide a high degree of dehumidification, the solution concentration in the absorber pool 14 should be maintained as high as possible; ideally, close to that in the desorber pool 26. At the same time, the temperature of the solution in the absorber pool 14 should be maintained as low as possible. Recovery of the solution concentration in the absorber/dehumidification section requires high transfer rates of solution between the absorber/dehumidification and desorber/regeneration sections. However, maintaining low temperature of the solution on the absorber side requires low transfer rates of solution between the absorber/dehumidification and desorber/regeneration sections.

To resolve the aforementioned contradictory goals, large exchange of concentration (mass) and a relatively large temperature difference between the hot side and cold side, an infinitely large solution-to-solution heat exchanger should be used. Solution-to-solution heat exchanger 20 facilitates preheating of the weak solution leaving the absorber and recovers heat from the hot strong solution leaving the desorber. As a large solution-to-solution heat exchanger is not practical, only part of the solution circulated in each of the reactors (absorber and desorber) is exchanged between them, with a split ratio (controlled by a splitter 36, which is typically requires a control system to attempt to attain and maintain an optimum split ratio). Such a split ratio strives for a low concentration difference between absorber 10 and desorber 22 together with minimum heat losses due to solution exchange between absorber and desorber. The system further includes an absorber/dehumidification section solution pump 38 (or any suitable means for causing solution flow) and a desorber/regeneration section solution pump 40 (or any suitable means for causing solution flow).

Prior art systems typically have to contend with the following issues:

1. Level control problems in absorber pool 14 and/or desorber pool 26: risk of flooding with excess solution on one hand; or solution deficiency on the other hand.
2. Heat losses and parasitic losses, due to solution exchange between absorber 10 and desorber 22.
3. The solution-solution heat exchanger 20 has excessive pressure drop (contributing to level control problems)
4. After a long idle time:
   Solution concentration in the absorber 10 decreases, increasing the time to reach steady operating conditions.
   It takes a long time to warm up the desorber 22 (need to minimize the amount of solution in the desorber/regeneration section)
5. The optimal split ratio (at splitter 36) is not constant and must be regulated as a function of operating conditions.

Figure 2:
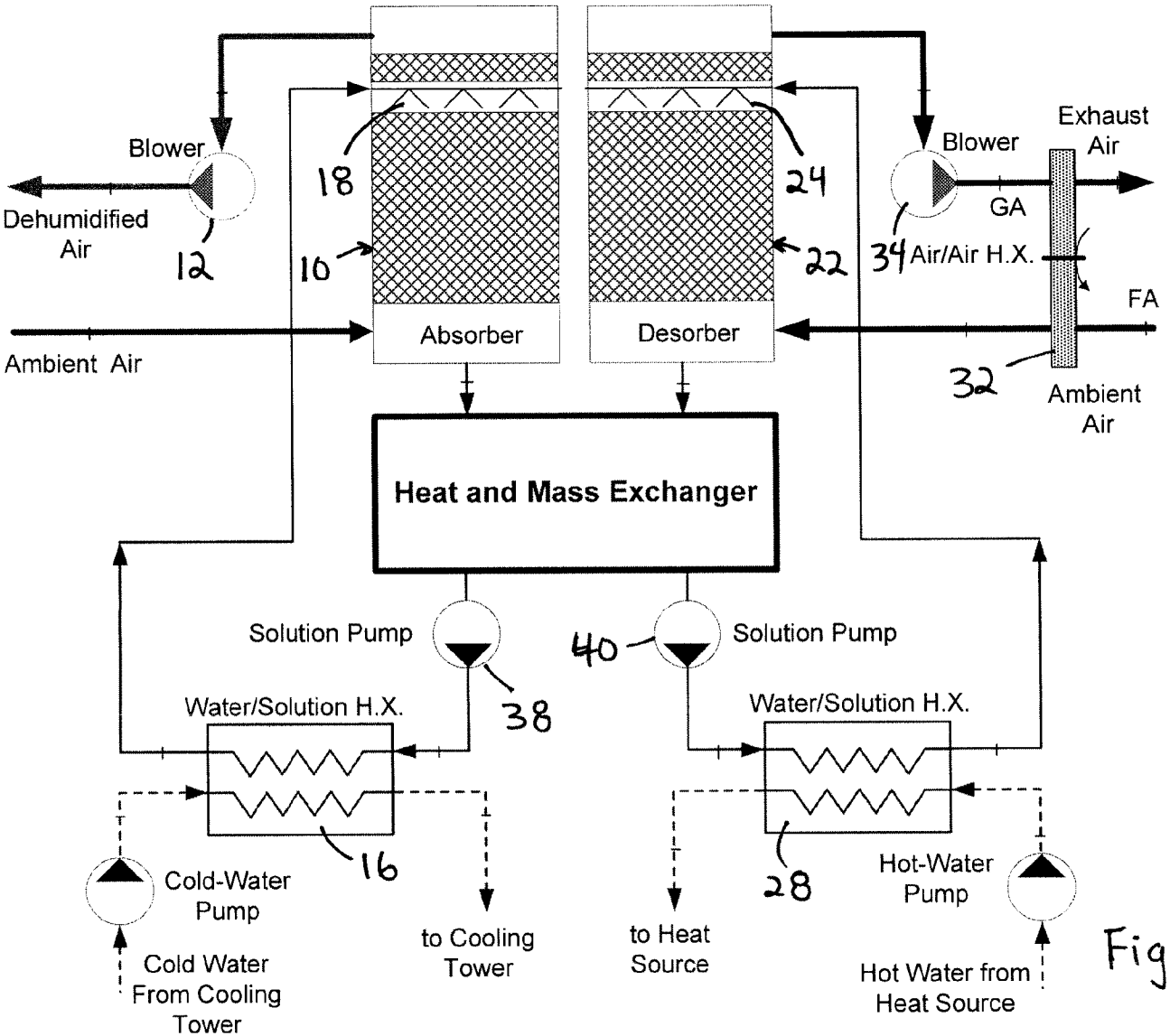
FIG. 2 is a schematic view of an embodiment of a liquid desiccant air conditioning/dehumidification system according to the present invention.

FIG. 2 schematically illustrates a liquid desiccant air conditioning/dehumidification system according to some embodiments of the present invention comprising a heat and mass exchanger in accordance with some embodiments of the present invention. As can be understood by inspection, the heat and mass exchanger serves to replace both the absorber and desorber pools 14 and 26 of the prior art system (FIG. 1) as well as the solution-solution heat exchanger 20. In some embodiments, splitter 36 is also not required due to the use of the heat and mass exchanger. The present system appears generally similar to the prior art system, however with certain advantages, as will become apparent upon description of exemplary embodiments of the heat and mass exchanger, described below.

Figure 3:
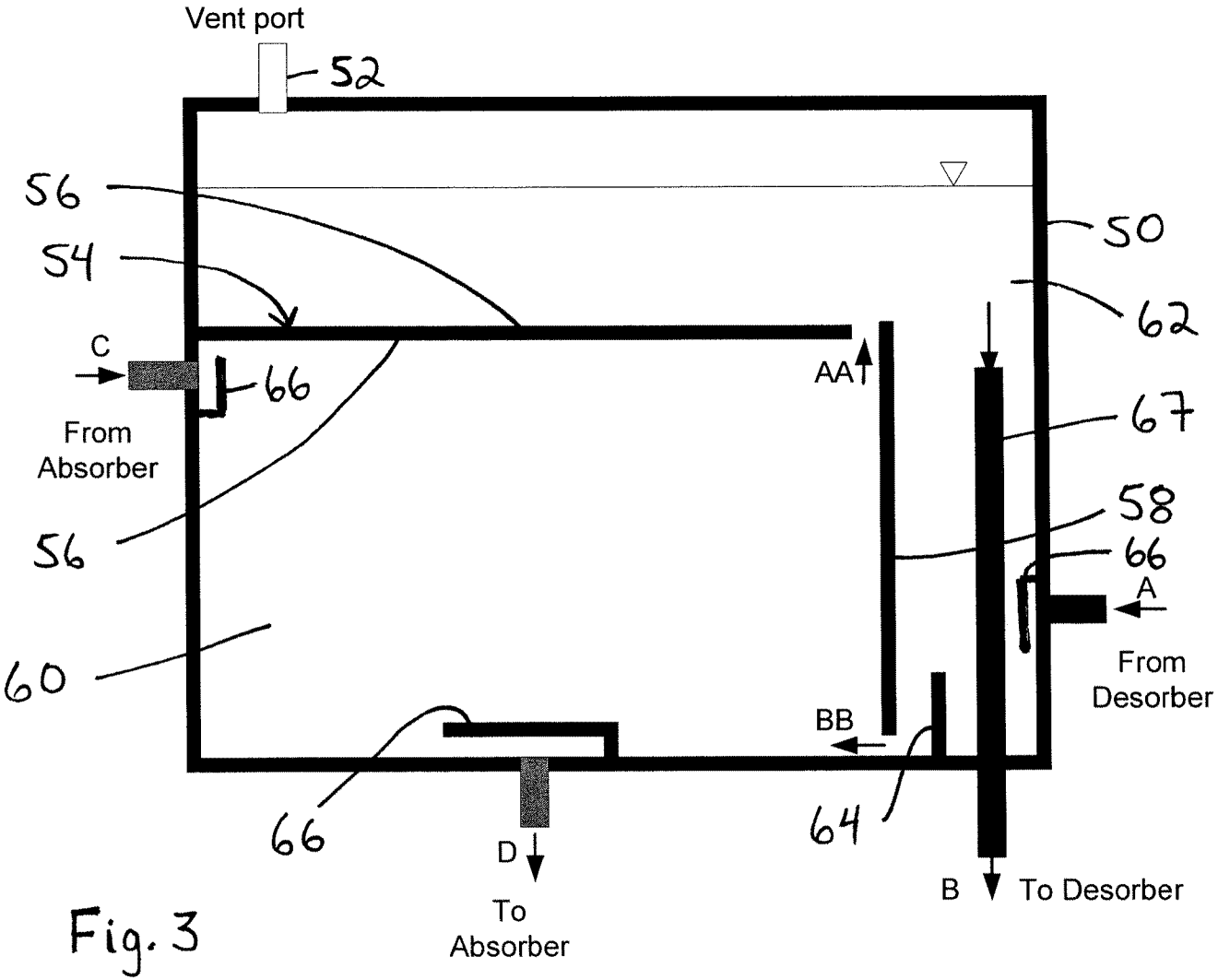
FIGS. 3-8 are schematic views of embodiments of a heat and mass exchanger according to the present invention.

FIG. 3 illustrates a first exemplary and simplified embodiment of the present heat and mass exchanger. The exchanger comprises an outer shell 50, typically with a vent port 52 and a partition 54 therein, for example comprising a generally horizontal wall 56 and a generally vertical wall 58. Partition 54 defines two sections, an "absorber solution" section 60 from/to which absorbent solution from the absorber 10 flows; and a "desorber solution" section 62 from/to which absorbent solution from the desorber 22 flows. It should be understood that the "absorber solution" and "desorber solution" both contain the same absorbent solution (e.g. Li—Cl solution), although at different temperatures and concentrations during operation, and that the terms are merely used to indicate from whence and to where absorbent solution flows in and out of the exchanger.

Absorber solution section 60 is typically relatively large, and during operation contains warm (though relatively cool) and relatively dilute solution, whereas desorber solution section 62 is typically relatively small, and during operation contains relatively hot and relatively concentrated solution. These two sections 60 and 62 are typically connected via two or more ports such as port AA and port BB, without significant hydraulic resistance. The exchange of absorbent solution between the absorber solution section 60 and desorber solution section 62 is controlled to a significant extent in a passive manner by means of natural convection, governed by concentration difference.

Absorber solution section 60 receives solution from absorber 10 through inlet C, at or proximate the top of section 60, and solution exits section 60 toward absorber 10 via outlet D, at or proximate the bottom of section 60. Likewise, desorber solution section 62 is connected to desorber 22 via inlet A and outlet B, which is typically disposed at the bottom of desorber solution section 62. Absorber solution section 60 is connected to desorber solution section 62 via absorber-to-desorber port AA at or proximate the top of section 60 (e.g. at wall 56 of partition 54); and via desorber-to-absorber port BB at or proximate the bottom of section 60 (i.e. at or proximate the bottom of wall 58 of partition 54). To minimize mixing and/or turbulence potentially caused by solution exiting desorber solution section 62 via desorber-to-absorber port BB, in some embodiments, the heat and mass exchanger further comprises a desorber-to-absorber passage protection member such as a wall 64, adjacent desorber-to-absorber port BB. Likewise, in some embodiments, the heat and mass exchanger also comprises absorber solution section inlet and exit flow protection members such as a flow protection wall 66, adjacent the inlets and outlets A-D. Furthermore, in other embodiments, any or all of the inlets and outlets have associated therewith a turbulence and/or mixing mitigation member such as wall 66. In some embodiments, leading to outlet B is a pipe 67 extending upward into desorber solution section 62 whereby solution entering this pipe and flowing into the top of desorber 22 tends to be less concentrated than that at the bottom of section 62.

Hot and concentrated solution arriving from desorber 22 (via inlet A) enters desorber solution section 62. Due to its higher density, the more concentrated portion of this solution tends to be at the bottom of the desorber solution section 62 and thus adjacent desorber-to-absorber port BB whereby more highly concentrated solution flows from desorber solution section 62 into absorber solution section 60. Advantageously, also for reasons of density, there is a tendency for cooler solution to descend toward the bottom of the desorber solution section 62.

Such solution that enters absorber solution section 60 from the desorber solution section 62 via port BB mixes with the warm (though relatively cool with respect to the solution from the desorber solution section 62) solution in section 60 whereby it is cooled. This relatively concentrated and cooled solution flows via outlet D to the absorber 10.

Typically at the same time, although the absorber/humidification and desorber/regeneration sections can be operated independently, relatively cool and dilute solution enters absorber solution section 60 via inlet C. This "absorber-side" solution cools the "desorber-side" solution that entered absorber solution section 60 via port BB, as mentioned, and is thus heated by that "desorber-side" solution. Advantageously, the less concentrated solution in absorber solution section 60 tends to rise and exit via port AA into desorber solution section 62. Again, advantageously and for reasons of density, there is a tendency for the hotter solution to rise toward the top of the absorber solution section 60.

Thus, not only is there performed a heat exchange as in prior art solution-solution heat exchangers through walls 56 and 58 of partition 54, and by the "passive" mixing of the absorber/dehumidification and desorber/regeneration section solutions, there is also a mass (concentration) exchange. Moreover, the flow inside the heat and mass exchanger is as desired and is influenced by passive means, density/gravity, which tends to be self-regulating. Furthermore, concentrated solution that accumulates at the bottom of sections 60 and 62 tends to result in a shorter start up time—time to reach steady state (operation).

FIGS. 4-8 illustrate exemplary embodiments; generally, modifications on the relatively simple embodiment of FIG. 3.

Figure 4A:
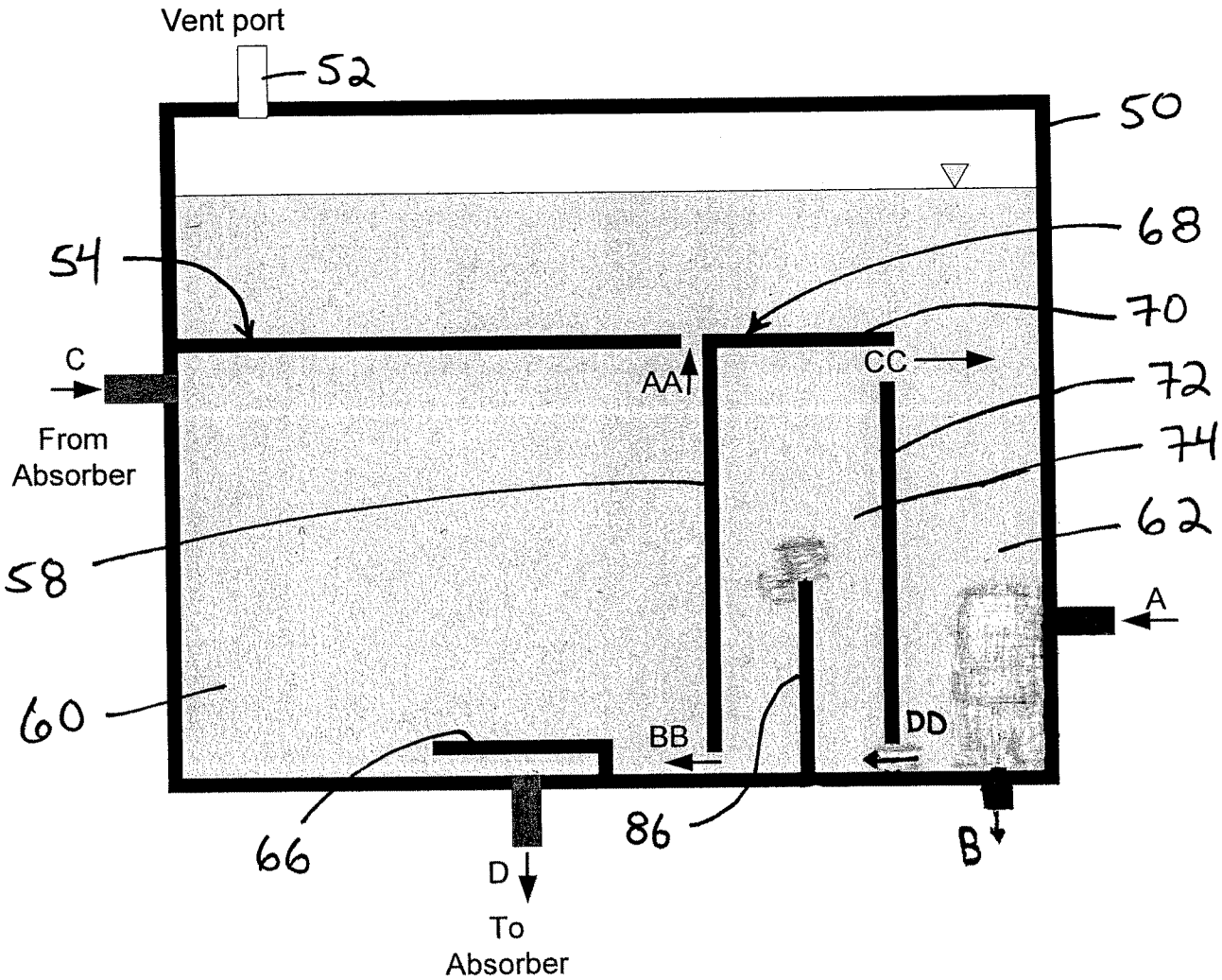
Figure 4B:
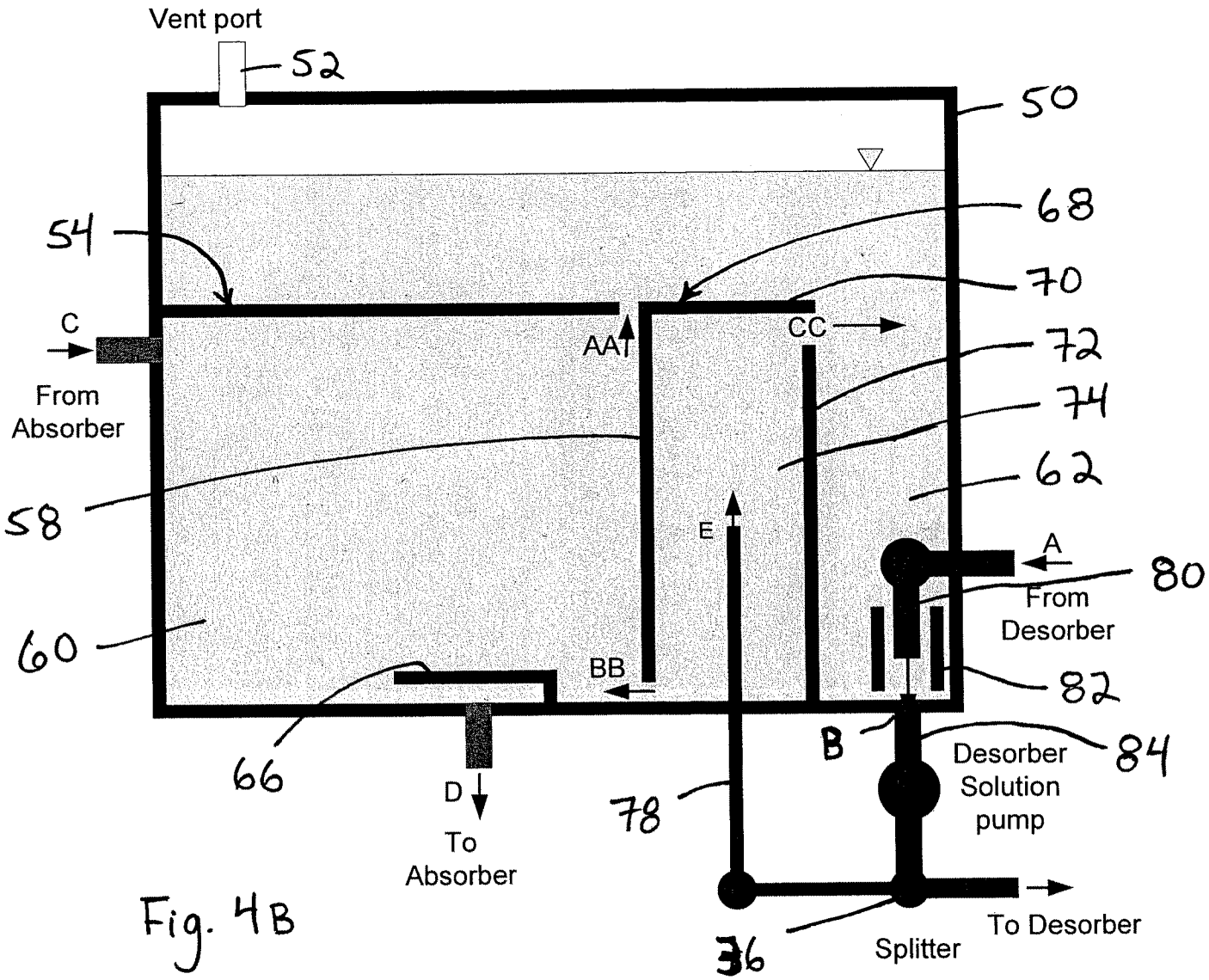

In the embodiments shown in FIGS. 4A and 4B, the heat and mass exchanger comprises an additional partition 68 having for example a generally horizontal wall 70 and a generally vertical wall 72. On the other hand, it can be considered that this heat and mass exchanger embodiment comprises one partition, composed of partitions 54 and 68. Upon the existence of partition 68 an additional section is defined, termed intermediate section 74, which is generally disposed between absorber and desorber solution sections 60 and 62. As a result, port BB is disposed at or proximate the bottom of wall 58 which now separates between absorber solution section 60 and intermediate section 74.

Instead of all the solution that exits the desorber solution section 62 from outlet B being returned to desorber 22, the heat and mass exchanger has an associated desorber/regeneration section outlet solution flow splitter, which can be like splitter 36 (though not requiring a control system, rather it can be set at a particular/constant split setting), for directing some of the solution outflow via piping 78 (externally) into intermediate section 74 at pipe outlet E, which typically extends about midway upward into section 74. It should be understood that the splitter function can be attained via suitable use of piping length and diameter to effect (set) a desired split. The less concentrated of the solution entering intermediate section 74 exits therefrom into desorber solution section 62 via a port CC located at or proximate the top of partition 68. To preserve a mass balance during operation, as a portion of the solution pumped from desorber solution section 62 flows into intermediate section 74 rather than back to the desorber, there is make up flow coming from desorber solution section 62 that is part of the flow returning to the desorber 22. Inlet A may have a desorber solution pipe 80 extending therefrom into desorber solution section 62; and with an annular baffle (or other suitably shaped member) 82 to mitigate turbulence and mixing. Typically, upstream of splitter 36 is a desorber-side outlet pipe 84 leading from outlet B. According to certain embodiments (not shown), the recycle arrangement including splitter 36 near outlet B and piping 78 can additionally or alternatively be implemented at the absorber solution section (i.e. at outlet D).

In the version shown in FIG. 4A, there is a port DD at or proximate the bottom of wall 72 for facilitating transfer of solution from desorber solution section 62 to intermediate section 74. In some embodiments, this design further includes an intermediate section baffle 86.

Warm and concentrated solution is collected in the intermediate section 74, especially near lower port BB, while warm and weak solution is collected in the absorber solution section 60, especially near upper port AA. The existence of strong and dense solution in intermediate section 74 and weak and light solution in the absorber solution section 60, promotes the flow of concentrated solution from the intermediate section through port BB to the absorber solution section, and in a flow of weak solution from the absorber solution section through port AA to the desorber solution section 62. The intensity of this solution flow rate to and from the absorber solution section 60, produced by natural convection, depends on the solution concentration difference between the absorber 10 and desorber 22.

The main volume of solution is stored in the absorber solution section 60, with a relatively small amount in the desorber solution section 62, contributing to small dead time to reheat the desorber side and therefore to a quick start of both absorption and desorption, and improved control—especially with the aforementioned design of FIG. 4B. Note however that absorption and desorption do not have to occur simultaneously; the former is performed when dehumidification is needed and the latter when solar (or alternative) heat is available. Concentrated solution produced in desorber 22 can be stored in the absorber/dehumidification section or in a separate tank (not shown) connected to it, thereby storing cooling capability.

Another advantage of the present heat and mass exchanger is that potential issues associated with the external solution-solution heat exchanger 20 have been eliminated, along with its associated parasitic power linked to the pressure drop and level control issues. Instead, the exchange of solution between absorber 10 and desorber 22 takes place in a passive mode, by natural convection. Also, level control of solution pools 14 and 26 sumps in the absorber 10 and desorber 22 is no longer needed, and, as these pools (sumps) have been eliminated, any excess solution can pass from the intermediate section to the desorber and absorber solution sections through ports CC and BB.

It should be noticed that the various ports are located such that stratification plays a role in an optimal way. For example, the concentrated and dense solution from the desorber 22, most of which enters intermediate section 74, transfers to the absorber solution section 60 through port BB located at or near the bottom of section 60, while the weak and light solution from the absorber 10 enters absorber solution section 60 through inlet C located at or near the top thereof and transfers to the desorber solution section through port AA also at the top.

Figure 5:
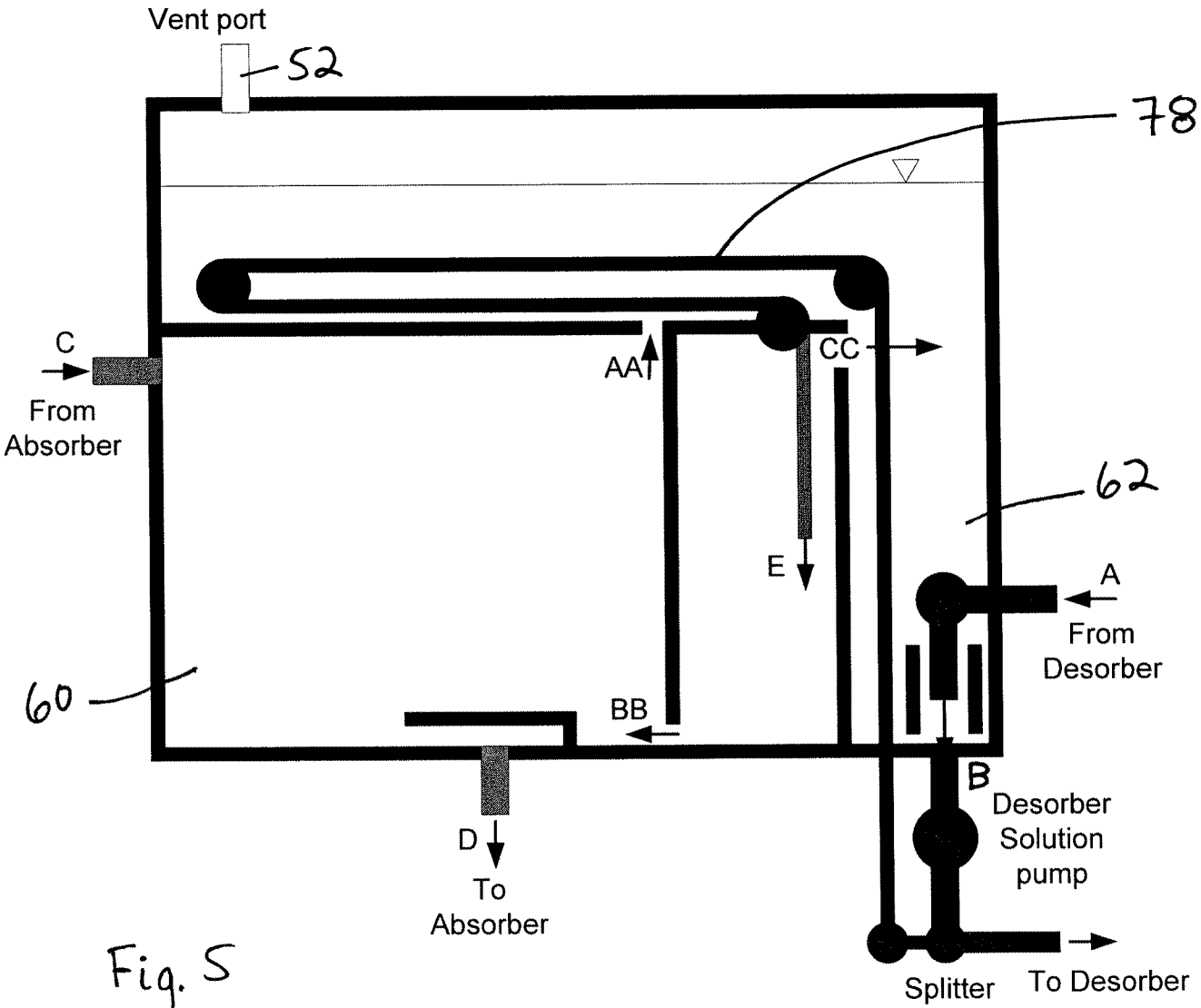

FIG. 5 illustrates another embodiment of the heat and mass exchanger similar to that of FIG. 4B, however, instead of piping 78 directly entering intermediate section 74 from splitter 36, the pipe first enters desorber solution section 62 preferably passing through an upper portion thereof, as seen in the figure, before entering intermediate section 74. This passing of piping 78 into desorber solution section 62 provides and internal heat exchange which serves to cool the solution in pipe 78 while recovering heat from it, transferring that heat into the desorber solution section 62.

Figure 6:
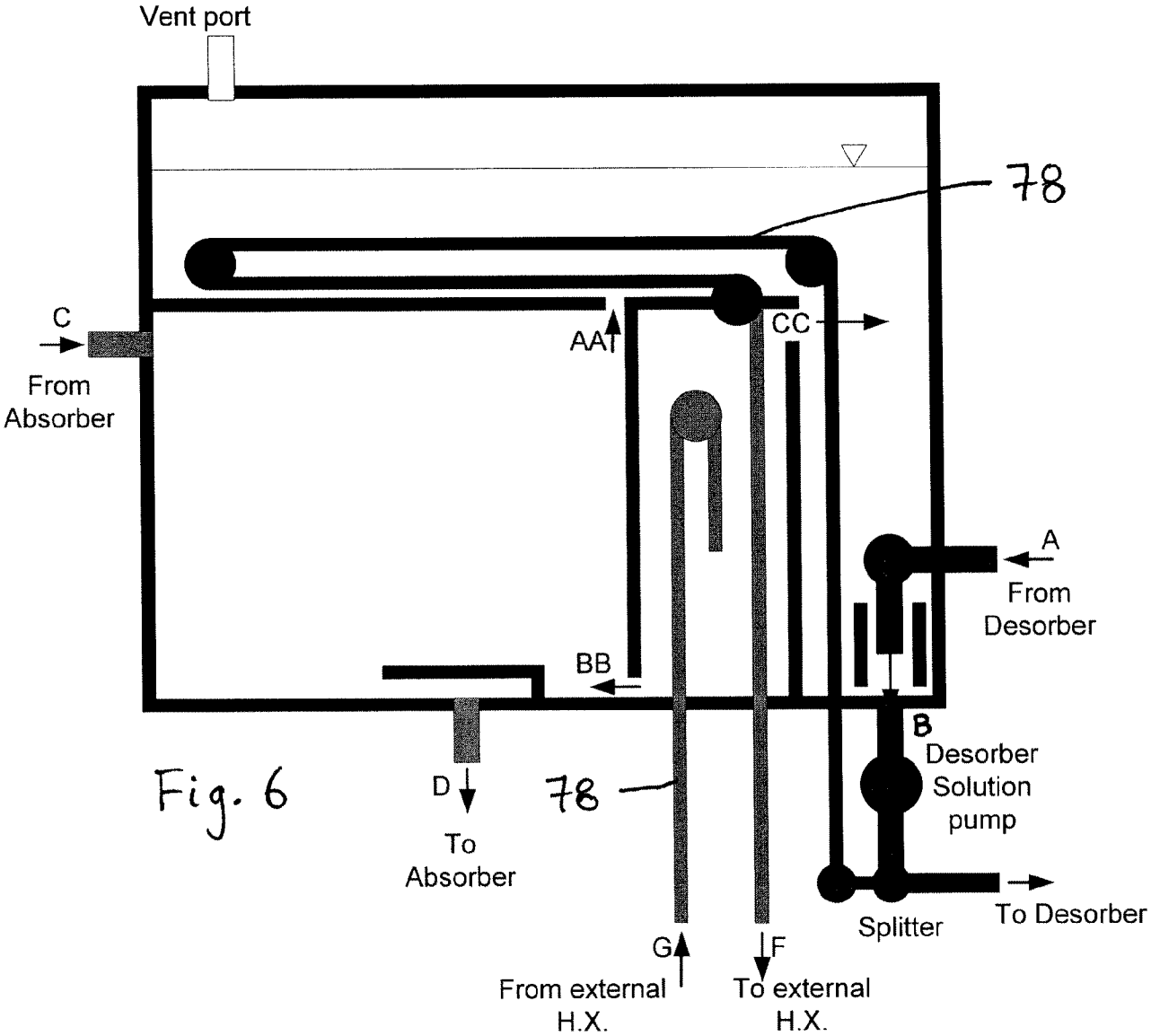

FIG. 6 illustrates another embodiment of the heat and mass exchanger similar to that of FIG. 5, however pipe 78 continues through intermediate section 74 onward to an external heat exchanger (not shown) before returning to section 74. The function of this external heat exchanger is to further cool the strong regenerated solution between heat exchanger inlet F and outlet G, thus lowering its vapor pressure and enabling it to absorb moisture better.

Figure 7:
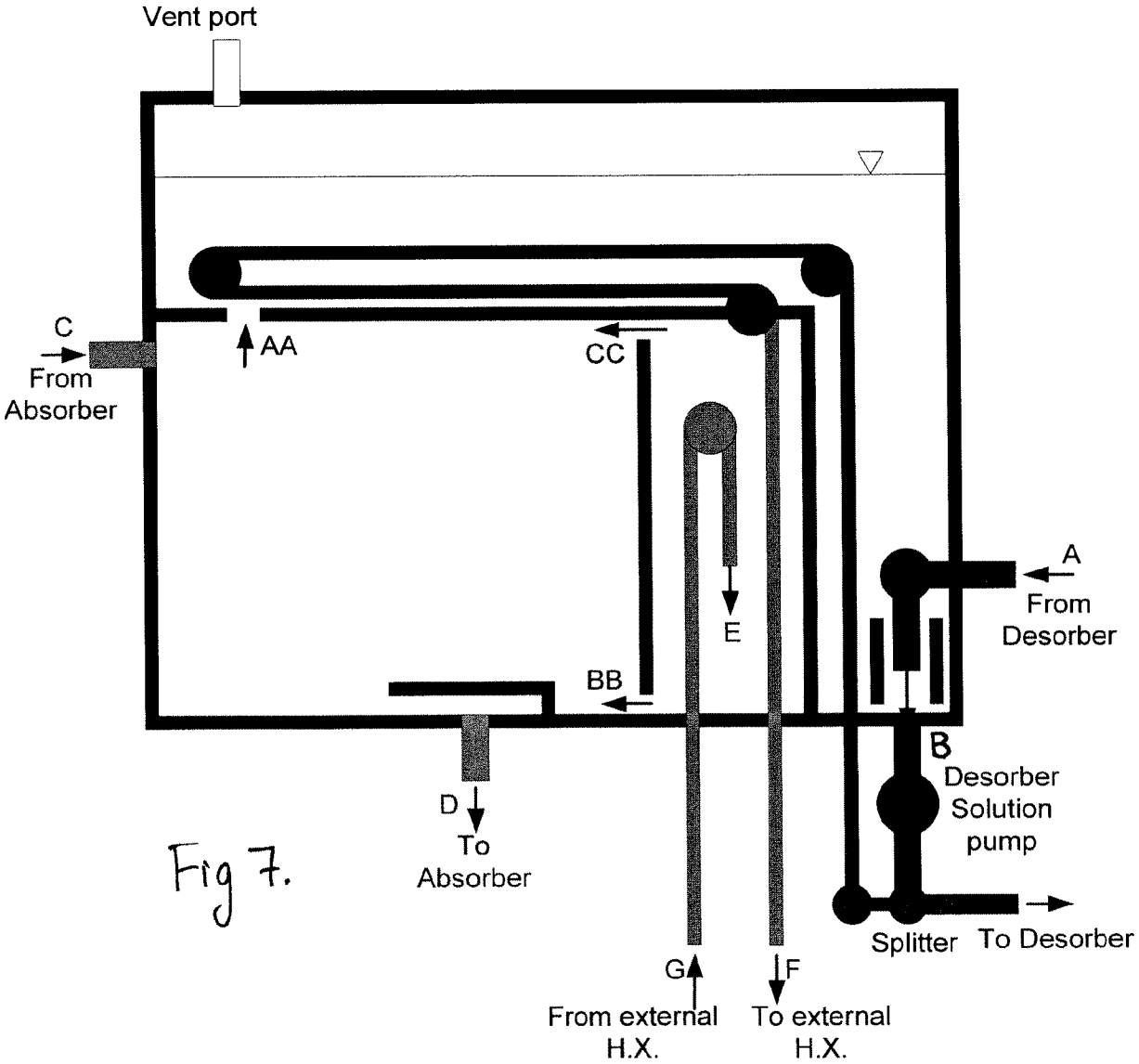

FIG. 7 illustrates another embodiment of the heat and mass exchanger similar to that of FIG. 6, however port CC interconnects between intermediate section 74 and absorber solution section 60 (rather than desorber solution section 74). In such case, port AA is preferably distanced from port CC (as shown) to avoid short circuiting of flows.

Figure 8:
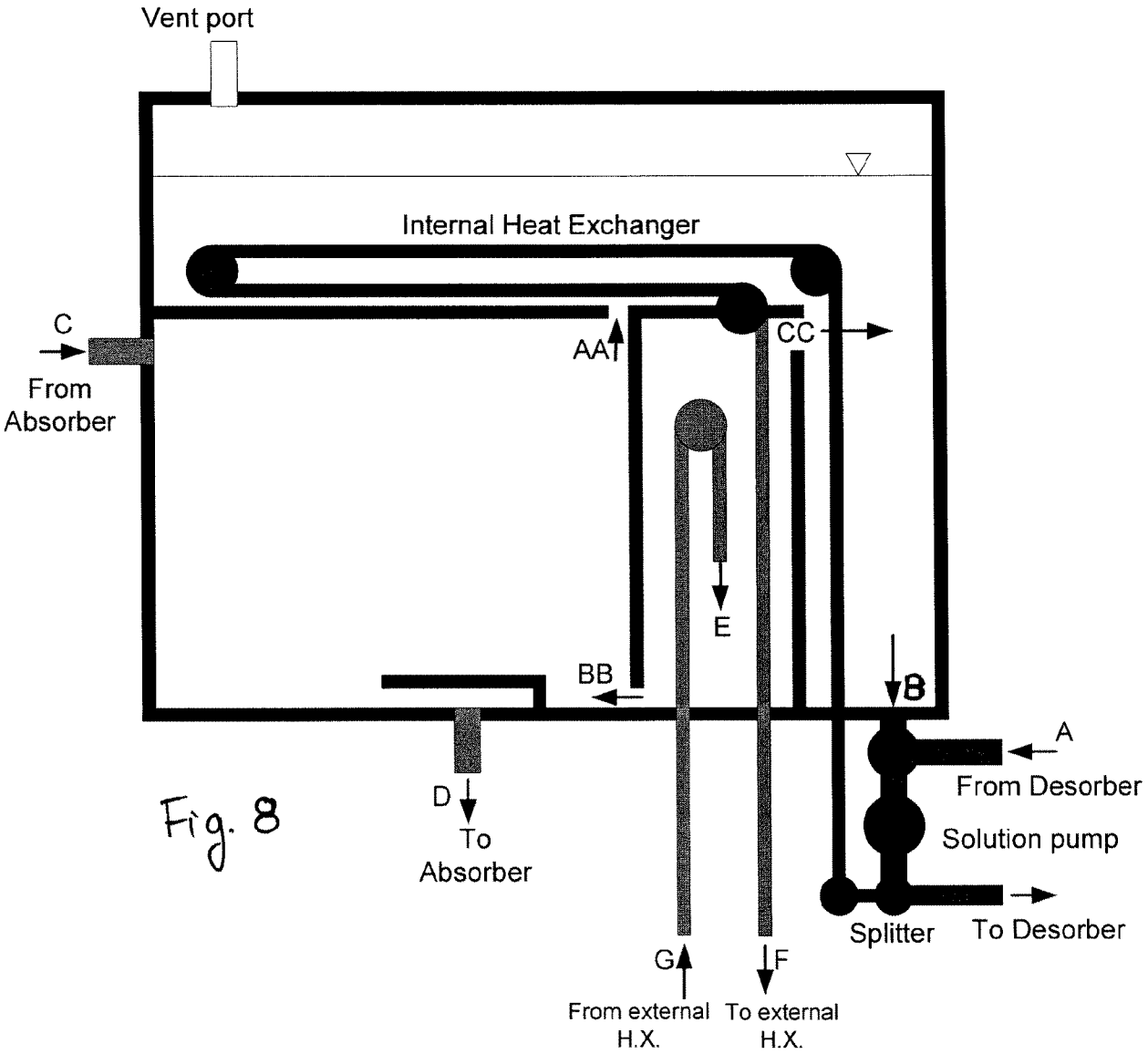

FIG. 8 illustrates another embodiment of the heat and mass exchanger similar to that of FIG. 7, wherein instead of inlet A leading directly to desorber solution section 74 it leads to desorber-side outlet pipe 84 which is external to outer shell 50.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A heat and mass exchanger for an open-cycle liquid desiccant air conditioning/dehumidification system having an absorber/dehumidification section with an absorber and a desorber/regeneration section with a desorber, the exchanger comprising:

an absorber solution section having an inlet for receiving weak liquid solution from the absorber/dehumidification section and an absorber solution section outlet disposed at or proximate the bottom of said absorber solution section from which strong liquid solution exits to the absorber/dehumidification section;

a desorber solution section having an inlet for receiving regenerated liquid solution from the desorber/regeneration section and a desorber solution section outlet from which liquid solution to be regenerated exits to the desorber/regeneration section;

a partition separating the absorber solution section and the desorber solution section, wherein said absorber solution section is disposed under at least a portion of said desorber solution section; and at least two section-connecting ports connecting between the absorber solution section and the desorber solution section, including a first section-connecting port disposed at or proximate the top of said partition and a second section-connecting port at or proximate the bottom of said partition, wherein during operation, the absorber solution section is full of relatively weak liquid solution which flows from the absorber solution section into the desorber solution section via the first section-connecting port; a relatively strong liquid solution flows from the desorber solution section into the absorber solution section via the second section-connecting port; a strong liquid solution exits the outlet of the absorber solution section; a liquid solution exits the desorber section via desorber solution section outlet; as well as there being heat transfer between the absorber solution section and the desorber solution section.

2. The exchanger according to claim 1, further comprising a pipe leading to the desorber solution section outlet and extending upward into the desorber solution section.

3. The exchanger according to claim 1, further comprising a mixing and/or turbulence mitigation member adjacent any or all of the section-connecting ports, inlets and outlets.

4. The exchanger according to claim 2, further comprising a fourth section-connecting port disposed at or proximate the top of said partition for facilitating flow of relatively weak liquid solution from an intermediate solution section to the other one of either one of the absorber solution section or the desorber solution section.

5. The exchanger according to claim 2, further comprising heat exchange piping for delivering at least some of the liquid solution entering the desorber solution section to an intermediate section, the heat exchange pipe configured to pass through the desorber solution section whereby liquid solution in the heat exchange pipe is cooled by liquid solution in the desorber solution section.

6. The exchanger according to claim 2, further comprising piping leading between an intermediate section and an external heat exchanger.

7. The exchanger according to claim 2, having associate therewith a splitter for directing some of the liquid solution exiting the desorber solution section into an intermediate section.

8. The exchanger according to claim 7, wherein the splitter is adapted to be set to a constant split ratio rather than having an associated control system.

9. The exchanger according to claim 1, wherein the partition is configured to define an intermediate section disposed between the absorber and desorber solution sections, the partition comprising at least three section-connecting ports including:

said first section-connecting port disposed at or proximate the top of said partition for facilitating flow of weak liquid solution from the absorber solution section to the desorber solution section;

said second section-connecting port disposed at or proximate the bottom of the partition for facilitating flow of relatively strong/concentrated liquid solution from the intermediate section to the absorber solution section; and a third section-connecting port disposed at or proximate the top of said partition for facilitating flow of relatively weak liquid solution from the intermediate solution section to either one of the absorber solution section or the desorber solution section.

10. An open-cycle liquid desiccant air conditioning/dehumidification system comprising:

an absorber/dehumidification section having an absorber for dehumidifying a fluid using a liquid desiccant solution;

a desorber/regeneration section with a desorber for regenerating the liquid desiccant solution, further comprising a heat and mass exchanger for a liquid desiccant air Conditioning/dehumidification system having an absorber/dehumidification section with an absorber and a desorber/regeneration section with a desorber, the exchanger comprising: an absorber solution section having an inlet for receiving weak liquid solution from the absorber/dehumidification section and an outlet disposed at or proximate the bottom of said absorber solution section from which strong liquid solution exits to the absorber/dehumidification section;

a desorber solution section having an inlet for receiving regenerated liquid solution from the desorber/regeneration section and an outlet from which liquid solution to be regenerated exits to the desorber/regeneration section;

a partition separating the absorber solution section and the desorber solution section, wherein said absorber solution section is disposed under at least a portion of said desorber solution section; and at least two section-connecting ports connecting between the absorber solution section and the desorber solution section, including a first section-connecting port disposed at or proximate the top of said partition and a second section-connecting port at or proximate the bottom of said partition, wherein during operation, the absorber solution section is full of relatively weak liquid solution which flows from the absorber solution section into the desorber solution section via the first section-connecting port; a relatively strong liquid solution flows from the desorber solution section into the absorber solution section via the second section-connecting port; a strong liquid solution exits the outlet of the absorber solution section; a liquid solution exits the desorber section via desorber solution section outlet; as well as there being heat transfer between the absorber solution section and the desorber solution section.

* * * * *